US005811718A

United States Patent [19]

Bateman

[11] Patent Number: 5,811,718

[45] Date of Patent: Sep. 22, 1998

[54] BULLET STOP AND CONTAINMENT CHAMBER WITH AIRBORNE CONTAMINANT REMOVAL

[76] Inventor: Kyle E. Bateman, P.O. Box 636, Provo, Utah 84603-0636

[21] Appl. No.: 477,178

[22] Filed: Jun. 7, 1995

Related U.S. Application Data

[63] Continuation-in-part of Ser. No. 334,571, Nov. 4, 1994, Pat. No. 5,535,662, which is a continuation of Ser. No. 204,682, Mar. 1, 1994, Pat. No. 5,400,692.

[51] Int. Cl.[6] ..... F41J 1/14

[52] U.S. Cl. ..... 89/36.02; 273/394; 273/404; 273/410

[58] Field of Search ..... 89/36.02; 273/410, 273/394, 404

[56] References Cited

U.S. PATENT DOCUMENTS

| | | | |
|---|---|---|---|
| 385,546 | 7/1888 | Decumbus . | |
| 694,581 | 3/1902 | Reichlin . | |
| 840,610 | 1/1907 | Easdale . | |
| 2,013,133 | 9/1935 | Caswell . | |
| 2,201,527 | 5/1940 | Freeman . | |
| 2,420,304 | 5/1947 | Diem . | |
| 2,772,092 | 11/1956 | Nikoden . | |
| 3,701,532 | 10/1972 | Nikoden | 273/102.4 |
| 3,722,182 | 3/1973 | Gilbertson | 55/124 |
| 3,737,165 | 6/1973 | Pencyla | 273/102.4 |
| 3,988,131 | 10/1976 | Kanazawa et al. | 55/126 |
| 4,114,521 | 9/1978 | Busch | 98/36 |
| 4,126,311 | 11/1978 | Wagoner | 273/102.4 |
| 4,164,901 | 8/1979 | Everett | 98/36 |
| 4,512,585 | 4/1985 | Baravaglio | 273/410 |
| 4,598,631 | 7/1986 | Everett | 98/33.1 |
| 4,683,688 | 8/1987 | Wojcinski | 52/79.1 |
| 4,744,910 | 5/1988 | Bossard | 210/748 |
| 4,821,620 | 4/1989 | Cartee et al. | 89/36.02 |
| 5,064,457 | 11/1991 | Weber | 55/385.2 |
| 5,070,763 | 12/1991 | Coburn | 89/36.02 |
| 5,088,741 | 2/1992 | Simonetti | 273/410 |
| 5,113,700 | 5/1992 | Coburn | 89/36.02 |
| 5,121,671 | 6/1992 | Coburn | 89/36.02 |
| 5,259,291 | 11/1993 | Wilson | 89/36.02 |
| 5,322,533 | 6/1994 | Todorovic | 55/472 |
| 5,433,763 | 7/1995 | Shagott et al. | 55/323 |

FOREIGN PATENT DOCUMENTS

| | | | |
|---|---|---|---|
| 523801 | 1/1993 | European Pat. Off. | 273/410 |
| 214433 | 10/1984 | Germany | 273/410 |

*Primary Examiner*—Stephen M. Johnson
*Attorney, Agent, or Firm*—Thorpe, North & Western, LLP

[57] ABSTRACT

A bullet stop and containment chamber for stopping the forward momentum of projectiles traveling in a generally horizontal zone of projectile travel and for containing the projectiles and fragments thereof. The bullet enters the chamber in which the inertial momentum of the bullet is arrested resulting in airborne particulate matter, bullets and fragments of bullets. The bullets and fragments settle out by gravity and the particulate matter are removed by a negative air pressure exerted on the chamber by means of a fan and ducting. The particulate matter is removed from the air by filtration means and the air is exhausted. The fragments and bullets drop from an egress in the bottom of the chamber into a removeably attached canister which is sealed and used to transport the emissions to recycling or disposal.

15 Claims, 5 Drawing Sheets

BULLET STOP AND CONTAINMENT CHAMBER WITH AIRBORNE CONTAMINANT REMOVAL

This is a continuation-in-part of U.S. patent application Ser. No. 08/334,571, filed Nov. 4, 1994, entitled "BULLET STOP AND CONTAINMENT CHAMBER," now U.S. Pat. No. 5,535,662 which is a continuation of U.S. patent application Ser. No. 08/204,682, filed Mar. 1, 1994, entitled "BULLET STOP AND CONTAINMENT CHAMBER," now U.S. Pat. No. 5,400,692.

BACKGROUND

1. The Field of the Invention

The present invention relates generally to apparatus for deceleration of projectiles, containment and recovery of those projectiles, their fragments and airborne particulate matter resulting therefrom. More particularly, it concerns apparatus for guiding a projectile into a chamber where successive armor plates contain the projectile within a confined area. The bullets, fragments and resulting particulate matter are then collected and confined for disposal or recycling.

2. The Background Art and Background of the Invention

It is understood that when a bullet or other projectile hits a surface it has a propensity to deform. This is particularly true for lead bullets hitting hard surfaces, as is often the case in target practice with small arms. This deformation is frequently in the form of fragmentation of the projectile into smaller components, even to the point of generation of airborne particulate matter. The terms "bullet" and "projectile" are used broadly herein. They mean the original body as placed in motion, as well as any fragments or particulate matter formed upon primary and subsequent impacts of the projectile and its fragments, as well portions of other projectiles which may be set in motion on impact with the projectile or its fragments. The terms "bullet" and "projectile" are used interchangeably.

The term "plate" is used herein in its broadest sense as a planar sheet of material capable of stopping or deflecting a projectile and its fragments. It will be understood by those of ordinary skill in the art, that selection of plate material is made in consideration of the nature and velocity of the various projectiles to be stopped and contained. For high velocity, high mass, jacketed bullets, the material of choice may be hardened steel plate or the equivalent; for projectiles from small air guns, a material with less impact resistance may be chosen. Similarly, plates intended to take primary, direct impacts will necessarily be stronger than those to take secondary or tertiary impacts from more acute angles.

Target practice is an activity pursued by many to enhance shooting skills, as criteria of employment, or for sport. It is customary in target practice to provide a means of stopping projectiles after they have traveled through or by a target, and before their potential to harm persons or damage property is concluded. This is traditionally accomplished by such means as providing adequate proximity between the target and persons and property, constructing a barrier such as an earthen berm, or strategically locating a solid fixture such as a wall or a metal plate. Proximity solutions involve massive facilities in light of modern weapons with long and powerful trajectories. This wastes valuable land resources and requires time consuming travel to less populated areas.

Merely providing an earthen or other barrier may stop the bulk of the projectiles, but has no effect on the indiscriminate distribution of lead, the primary material used for projectiles, into the environment. Lead is a heavy metal environmental contaminant increasingly implicated as a health risk to humans and animals.

Simple barriers are subject to wear and eventual failure. Simple barriers and fixtures may stop a projectile, but allow lead fragments or particulate matter to escape to the environment. Barriers without containment deflect bullets which may retain enough velocity to harm bystanders, the shooter, or property. These barriers still require a significant proximity solution due to deflected projectiles. Barriers without containment lose the bullets to the surrounding environment and disallow recycling the matter into new projectiles or other usable goods.

It has been long recognized that airborne contaminants resulting from the discharge of firearms in a defined space are undesirable. This has been addressed, for example in U.S. Pat. No. 4,164,901 to Everett (1979), by improving the circulation and ventilation systems in the range to filter and recirculate vast quantities of air in the entire enclosure at a rate of about 75 feet per minute. These proposals address all of the air in the range as if it were contaminated uniformly.

Emphasis has also been placed on containing the harmful airborne products of target firing of firearms as these activities have moved indoors out of convenience and necessity, and as the toxicity of lead and other by-products has become more apparent. Another benefit of containment is that it enables recycling bullet components to reduce the ultimate cost of the enterprise and to reduce the environmental burdens of mining and refining virgin materials.

Solutions to the problems set forth above moved from violent impacts that quickly disintegrate projectiles, to more controlled deceleration of projectiles to limit the amount of resulting airborne particulate. The means often used were deflection to a defined chamber where the bullets are said to decelerate in tact. It has also been attempted to frictionally decelerate the projectile in a block of, for example used rubber or in liquid baths and sprays.

Contained deceleration results in less violent but sustained disintegration, still generating unwanted airborne particulate. Frictional deceleration results in cross contamination of materials used to slow the projectiles (rubber blocks, sand, water and the like). These solutions only result in yet new environmental challenges for the containment and disposal of contaminant by-products.

For example in U.S. Pat. No. 4,821,620, to Cartee et al. (1989), it is described to provide a screen of rubber-like material followed by a deflector plate. Large fragments fall by gravity to a chamber below, but any airborne particulate and some fragments are free to escape to the environment. This is particularly the case as the rubber-like membrane wears and this matter freely escapes in the general direction of the shooter. Fragmented matter also builds up and re-collides with newly introduced projectiles and fragments thus causing secondary contaminants.

Others including Bravaglio in U.S. Pat. No. 4,512,585 (1985), and Coburn U.S. Pat. No. 5,070,763 (1991), describe containment chambers with curved portions said to reduce the velocity of projectiles as they travel along the curved surface. In the Bravaglio device there is no means for containment of airborne particulate which moves freely in and out of the openings in the chamber and as it is disturbed by subsequent violent collisions. Coburn describes the cross contamination of liquids introduced into the chamber and new generation of particulate matter outside the chamber as newly introduced projectiles collide with the old ones moving out of the chamber. The curved plate used in these devices is costly to manufacture, transport, store, and assemble. It is very bulky as compared to flat plate. Virtually all of the energy from projectiles over time in these devices is absorbed in a very limited area of the curved or otherwise complex structure in these chambers, necessitating expensive repair, reconstruction, or replacement.

All of these solutions suggest means for containing bullets and large fragments, but none adequately addresses the complete containment of airborne by-products of controlled deceleration. Neither has the cross-contamination of frictional deceleration materials, such as water and rubber, been adequately addressed. The contaminated matter merely becomes an additional disposal challenge. Containment within a chamber thus remains the solution of choice.

There is thus a need to provide a bullet stop and containment chamber in which bullets are guided to a chamber in which deceleration is accomplished without curved plate and the fragmental and particulate by-products are effectively contained and managed, and, from which a minimum of cross contamination of other matter occurs.

Those having ordinary skill in the art will appreciate that these and other needs are met by the present invention.

OBJECTS AND SUMMARY OF THE INVENTION

It is therefore an object of the present invention to provide a bullet stop and containment chamber with a defined containment chamber to prevent the escape of bullets, fragments and airborne particulate matter and the effective management thereof.

It is another object of the invention to provide such bullet stop and containment chamber which eliminates or minimizes the cross contamination of liquid, rubber or other materials.

It is an additional object of the invention to provide such bullet stop and containment chamber without the use of curved plate.

It is also an object of the invention to provide such bullet stop and containment chamber in which the primary wear is focussed on readily replaceable parts of stock plate.

It is a further object of the invention to provide such bullet stop and containment chamber in which bullets and fragments are collected in a manner such as to avoid secondary generation of smaller fragments and particulate matter from subsequent collisions with newly introduced projectiles.

It is still another object of the invention to provide a chamber with an egress for removal of the by-products of deceleration from the chamber into a self contained and reusable canister without compromising the complete containment of the by-products.

The above objects and others not specifically recited are realized in specific illustrative embodiments of a bullet stop and containment chamber for arresting and containing the inertial momentum of projectiles traveling in a generally horizontal zone of projectile travel. Projectiles enter the chamber through a restricted opening.

The containment chamber has a series of plates arranged with increasing angles of incidence such that sequential impacts of projectiles and their progeny are increasingly direct with impact plates. There are also side or top plates on the chamber which combine with the other structure to confine bullets, fragments and particulate matter in the chamber until inertial movement ends and the bullets and fragments drop through an egress or into a holding container with little chance of subsequent impact with newly introduced bullets.

The impact plates may be arranged such that the first plate absorbs the primary impact at an acute angle, the next at a less acute angle and so on until the bullets and fragments strike a final impact plate at a more or less perpendicular angle. The first impact plate is protected from wear by the acute angle of impact. The first impact plate is removable and readily replaceable on-site by simply sliding it out of position and replacing it with another. Other plates are similarly user-serviceable.

The chamber is enclosed with the exception of the ingress from the channel and an egress extending from the bottom of the chamber in an overlap between the two lowest plates. This allows the bullets, fragments, and particulate matter to drop through into a canister for collection, transport and recycling.

In yet another illustrative embodiment of a chamber, the chamber is defined by a first impact plate which is generally perpendicular to the travel of the projectile, side containment plates and an air-restricting curtain which restricts the flow of air from the general direction of the shooter. When a projectile strikes the first impact plate, it exits in a conical pattern as described in my copending U.S. patent application Ser. No. 08/315,552, which is adopted hereto and incorporated herein by this reference. Said exiting material is then arrested by subsequent impacts.

In any event, the containment chamber has restricted pneumatic communication between its interior and exterior, restricted to that necessary for the efficient ingress of moving projectiles and inconsequential interstices; it arrests inertial movement of projectile and fragments; and, restricts, and, as later described prevents, the movement of airborne particulate matter to the outside environment.

A negative air pressure is exerted on the chamber to prevent the movement of airborne particulate matter from within the chamber to ambient air. This is accomplished by connecting air ducts to the chamber in connection with an exhaust fan, thereby removing a portion of the contaminated air from the chamber which is replaced with fresh air moving into the chamber through its openings and interstices between its components. The exhaust fan moves the contaminated air to the outside of the building where the contaminants are filtered and removed for recycling or disposal.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENT OF THE PRESENT INVENTION

Figure 1:
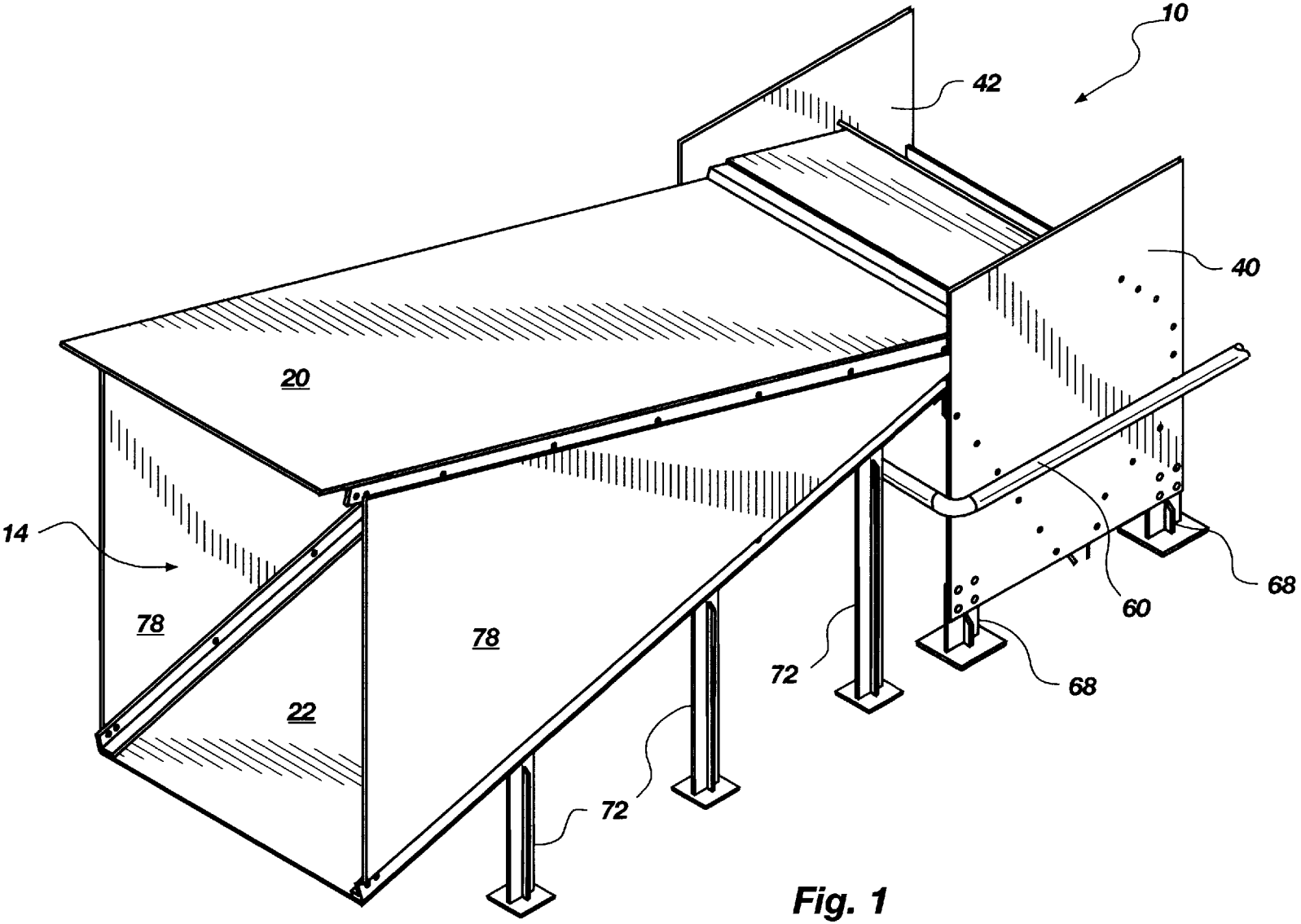
FIG. 1 is a perspective view of a bullet stop and containment chamber with guide plates and an area-restricted entry chamber made in accordance with the principles of the present invention.

Reference will now be made to the drawings wherein like structures will be provided with like reference numerals.

Figure 2:
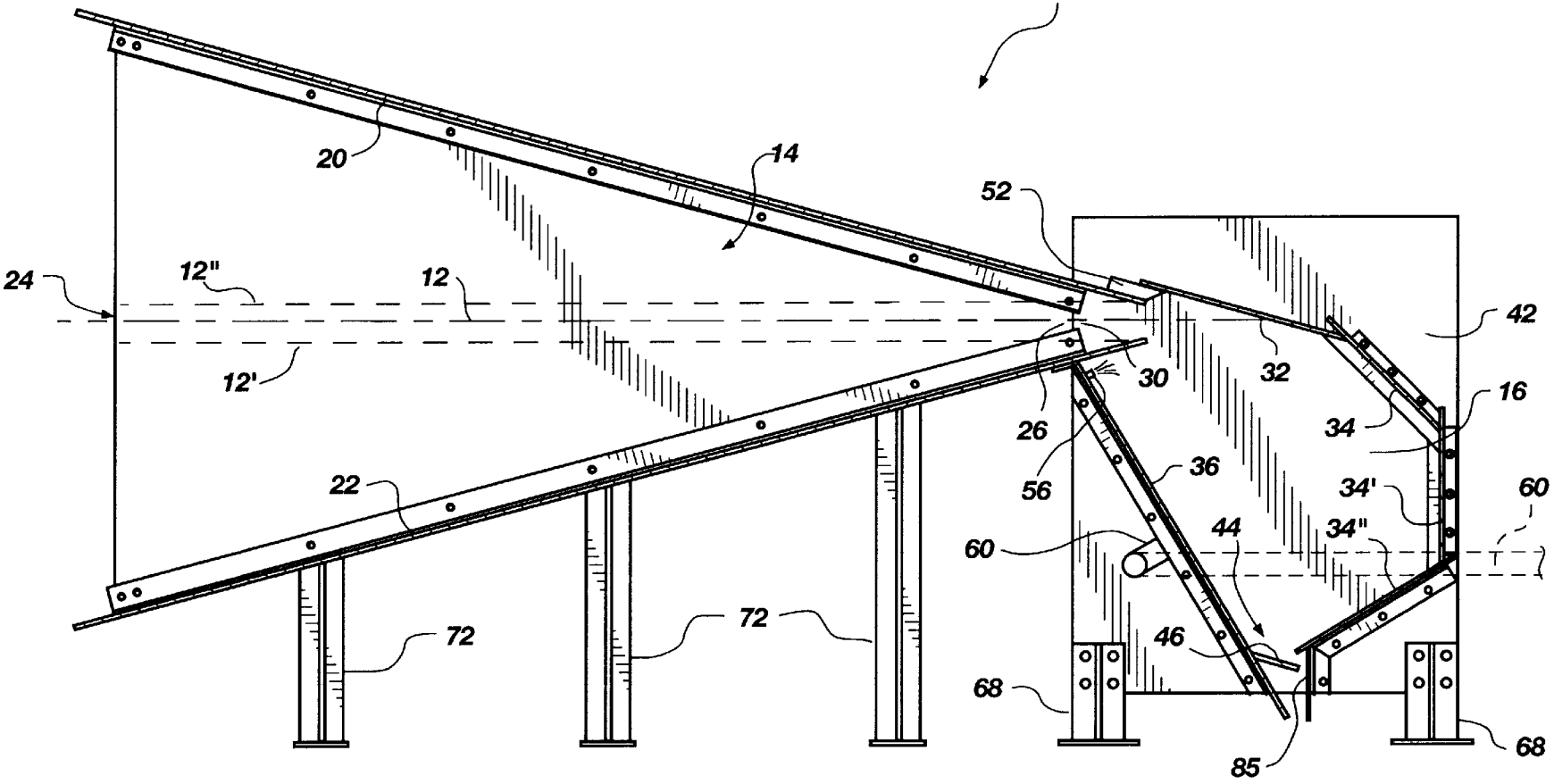
FIG. 2 is a side cross sectional view of the bullet stop and containment chamber of FIG. 1 taken along the midline.

Referring to FIGS. 1–2, there is shown, generally designated at 10, a bullet stop and containment chamber for stopping the forward momentum of projectiles traveling in a generally horizontal zone of projectile travel 12. The bullet stop and containment chamber comprises generally a channel 14 and a containment chamber 16.

The channel has an upper plate 20 and a lower plate 22 arranged on complementary acute angles to the generally horizontal zone of projectile travel 12. As a bullet is fired it travels from the wide opening in the channel 24, to a narrow opening 26. If a projectile is on a trajectory 12' which is lower than the narrow opening 26 it is deflected by the lower plate of the channel 22 back into a conforming path 12. If a projectile is on a trajectory 12" which is higher than the narrow opening 26 it is deflected by the upper plate of the channel 20 back into a conforming path 12. In any event, the projectile is guided into the narrow opening 26 by the plates which are at generally acute angles (10°–30° but optimally 15°) to horizontal, so that the projectile remains in tact while traveling through the channel and into the chamber.

The narrow opening of the channel 26 is substantially coextensive with an ingress 30 to the chamber. As the projectile travels through the ingress 30 it impacts with the primary impact plate 32. The impact plate 32 is at an equal or greater angle of incidence with the generally horizontal zone of projectile travel 12 so that the impact with the plate 32 is of equal or greater force than the general impact the projectile may have had with either the upper 20 or lower 22 channel plate. The result of projectile impact with the primary impact plate 32, is that the bullet or fragments thereof are deflected in the general direction of the first in a sequence of impact plates 34 which is of an increased angle of incidence, than the primary impact, with the general deflected path of travel of the projectile or its progeny. Subsequent impact plates 34'–34" are of marginally increasing angles of incidence with each subsequent deflected angle of projectile travel. For example, in the preferred embodiment the upper plate of the channel 20 and lower plate 22, are at complementary angles 16° from the generally horizontal zone of projectile travel 12; the primary impact plate 32 is on a similar angle to the generally horizontal zone of projectile travel 12; the angle formed between the primary impact plate 32, and the first sequential impact plate 34 is 150°; the angle formed between the first sequential impact plate 34 and the second sequential impact plate 34' is 288°; the angle formed between the second sequential impact plate 34' and the third sequential impact plate 34" is 70°; and the angle formed between the third sequential impact plate 34" and the terminal impact plate 36 is 90°. At each turn the projectile is subjected to increasingly direct impacts, but having less inertial momentum, the respective plate is able to withstand the increased directness. Therefore, as the projectile looses its inertial momentum, an increasingly large potential for stopping the projectile is encountered via a subsequent and more direct impact plate.

The terminal impact plate 36 terminates adjacent the chamber ingress 30. Thus, the impact plates 32–36 form a series of more or less continuous impact surfaces extending from the top of the chamber ingress 30, to the bottom of the chamber ingress 30.

At each end of the series of continuous impact surfaces formed by the impact plates 32–36, there are disposed a first end plate 40 and a second end plate 42. In combination the impact plates 32–36 and the end plates 40 and 42, form a continuous chamber 16. Ingress of projectiles occurs through the chamber ingress 30 already described. Once a projectile enters the chamber 16 it sequentially impacts the impact plates 32–36 as described hereinabove. After projectiles loose their inertial momentum they are obviously acted upon by gravity in such a way as to tend toward the lowest point of the chamber. In this embodiment the lowest point in the chamber is defined by the third sequential impact plate 34" and the terminal impact plate 36. The third sequential impact plate 34" and the terminal impact plate 36 slope together to define an egress 44 to the chamber. In this embodiment a check plate 46 is disposed at the egress to further prevent the inadvertent fragment from escaping the chamber with significant inertial momentum. It will be appreciated by those of ordinary skill in the art that the same effect can be accomplished by the overlap of the plates in such a way as to allow egress of a gravity-driven projectile but not of a projectile moving under inertial forces. The egress allows the resultant matter to escape the chamber upon its arrest to avoid ongoing collisions with newly entering projectiles, and thus, the continuing creation of more and more airborne particulate. The egress is directed to a collection system further and later herein described in association with FIG. 3.

The plates described are attached to each other by means known in the art, i.e. securely bolting angle iron to the respective plates on surfaces outside the chamber or channel. Exceptions to this method of construction are with regard to the primary 32 and first sequential 34 impact plates, which have been found to take the bulk of the forces from projectiles. The primary impact plate 32 rests on an extension 52 of the upper channel plate 20, on its edge proximal to the upper channel plate, and, on the distal edge on extensions from structure associated with the first sequential impact plate 34 and end plates 40 and 42. This arrangement allows for easy replacement of the primary impact plate 32 upon wear. If a part is found to wear it can be readily replaced from appropriate plate stock, unlike formed and integral or complex chambers. An additional advantage is that the other chamber parts can be constructed from less impact resistant, and thus, less costly and bulky materials.

It will be appreciated by those of ordinary skill in the art that a projectile containment chamber will evolve a certain amount of particulate matter and fragments from the repeated impacts of bullets with impact surfaces, and from impacts with residual matter within the chamber. It is desirable to contain and collect these materials for re-use and to prevent their escape to the surrounding environment.

As is discussed above, the chamber 16 is generally closed with the exception of an ingress 30 and an egress 44. This containment generally prevents the escape of projectile by-products.

The airborne particulate emissions are drawn from the chamber 16 by means of an aperture (not depicted) disposed centrally in the terminal impact plate 36, by means of a duct 60 which is in pneumatic contact with the chamber. The aperture is placed in the terminal impact plate because that is the area of the chamber which has the least violent impacts of the smallest fragments. It will be appreciated that this aperture can be provided with a shield to protect the duct, or the duct can be made of substantially impact and wear resistant materials. In the preferred embodiment the aperture is made of a number of relatively small holes drilled in the terminal plate which combine to form a screen sufficient to protect the duct from impact damage. The duct leads to a motor-driven fan hereafter described, or some other means for exerting a negative air pressure on the chamber 16 by means of the duct 60. The air is then filtered of contaminants and exhausted as more fully described hereinafter.

It will be appreciated that a sufficient volume of air should be drawn to 1) create a negative air pressure in the chamber, and 2) draw enough air into the chamber through the chamber ingress 30 and any interstices between the plates to substantially eliminate the movement of contaminated air through them into the shooting environment. No substantial amount of air is drawn from the chamber egress for reasons that will shortly become apparent. In the preferred embodiment about 35 CFM per lineal foot of chamber entrance has been found to be sufficient. It will be appreciated that the area of the chamber ingress 30 can be increased and the volume of air moved from the chamber can accordingly be increased to move air contaminated by the combustion propulsion gasses of fire arms away from the shooters toward the chamber and eventually and desirably filtered and exhausted as hereinafter described. Also, any inadvertent particulate matter created in the channel 14, are likely to move into the chamber and be so treated. These particulates are increasingly likely to be created proximate to the chamber where the volume of air moved is also likely to be more powerful due to the decreasing cross sectional area in the chamber as the projectile moves toward the chamber ingress.

The chamber is supported by four legs 68 attached, two each, attached to the two end plates 40–42.

The lower channel plate 22 is supported by six legs 72 extending from points on the channel plate 22, to the support surface (not depicted), and thereby support the lower channel plate 22 without obstruction of the wide opening of the channel 24. The upper channel plate 20 is supported by the vertical channel plates 78 extending upwardly from the lower channel plate 22 or by means of a cantilever system described in U.S. Pat. No. 5,400,692.

Figure 3:
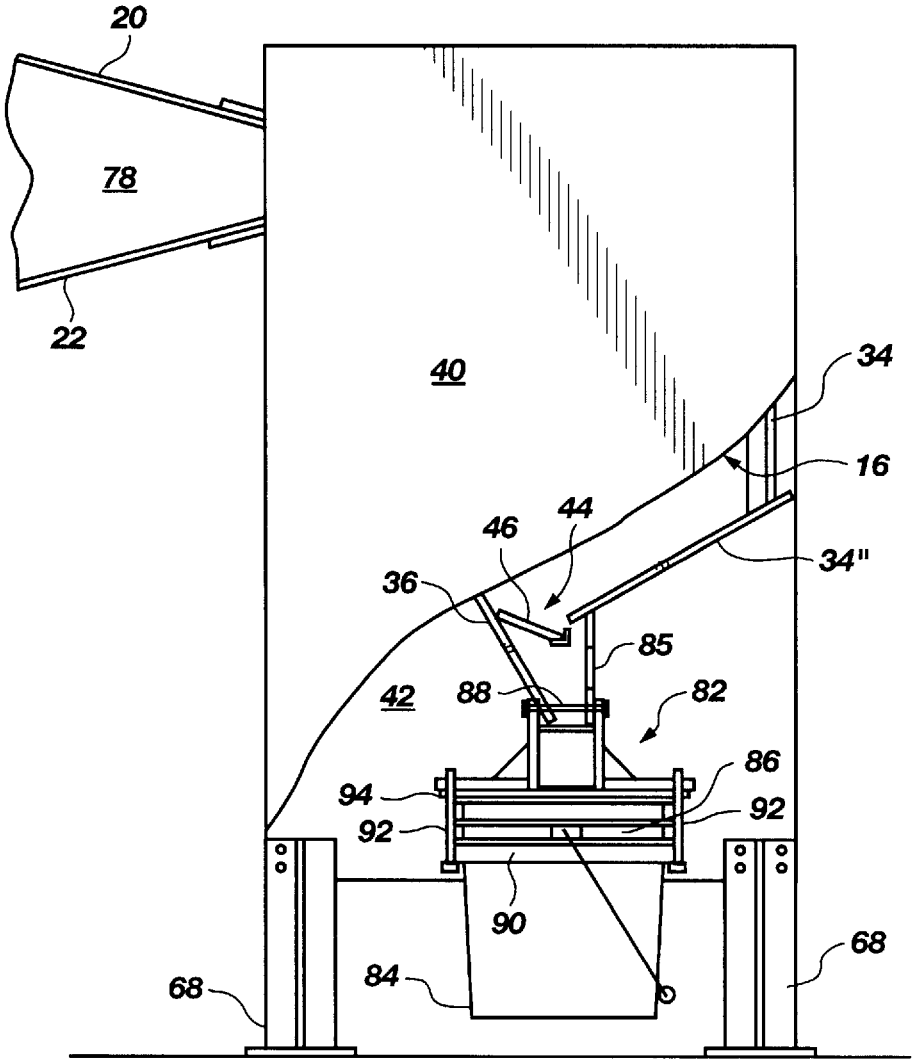
FIG. 3 is a partially cut away side view of the container detail of the containment chamber of FIG. 1.

Depicted in FIG. 3, is detail of a containment system depicted generally at 80 extending from below the chamber egress 44. The containment system has a canister aperture adapter 82 which is adapted to attach to and complement the chamber egress defined by the lower end of the terminal impact plate 36 and an extension 85 of the last sequential impact plate 34", and the top of a canister 84. The adapter 82 is attached to the chamber egress structure by bolts 88, and to the canister 84 as will momentarily become apparent.

The canister 84 is fitted at its upper circumference with a rim 86. The canister is held against the aperture adapter 82 by means of bars 90 drawn tightly against a portion of the rim 86 by means of bolts 92 removeably attached to the lower edge 94 of the aperture adapter 82. In this manner the by-products emitted from the chamber egress 44, fall into the canister 84, and are continuously contained. At an appropriate time the canister can be removed and replaced. A lid (not depicted) is sealingly fitted and the by-products, primarily lead, are transported in the canister for recycling or disposal. In this fashion the non-airborne chamber emissions are continuously contained from generation to a recycling or disposal point, thus significantly reducing the potential for environmental contamination thereby. This system also eliminates the need to manipulate the by-products by means of shoveling, conveyer systems and the like. In the preferred embodiment three such containment systems are provided in series for each 4' lateral section of chamber. It will be appreciated that the canister can be formed from a variety of materials and may take a variety of shapes.

Figure 4:
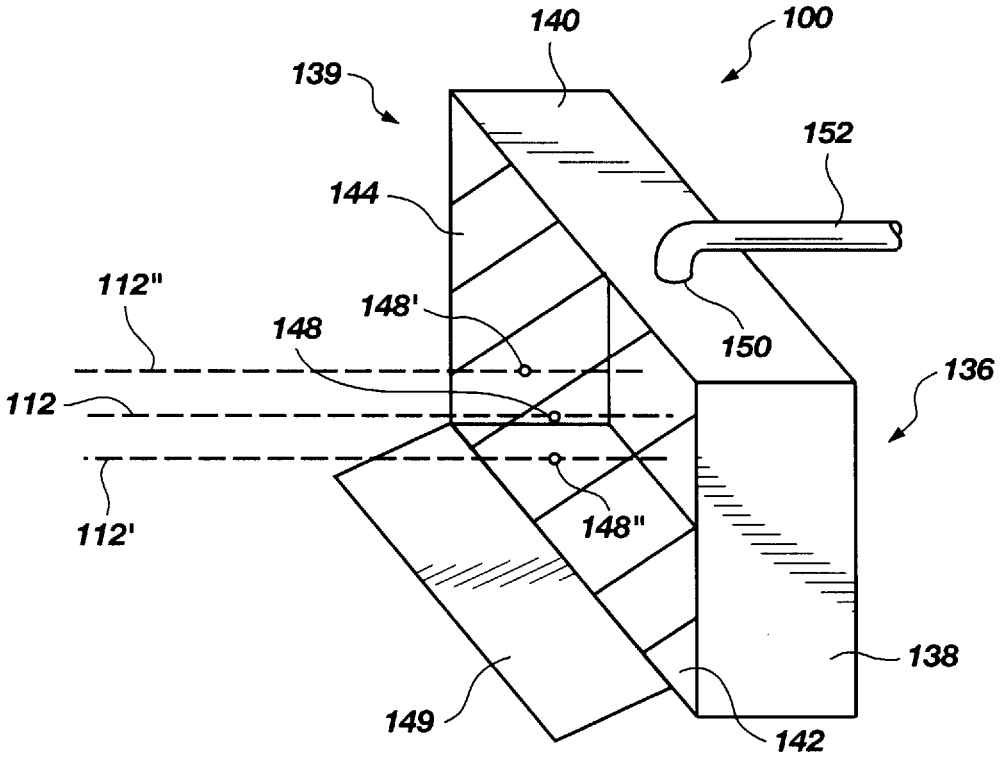
FIG. 4 is a perspective view of yet another bullet stop and containment chamber having a curtain covering its chamber opening; and, FIG. 5 is a schematic representation of a system for exerting a negative air pressure on the chamber and filtering contaminants therefrom.

Depicted in FIG. 4, is a bullet stop and containment chamber formed by a bullet stop generally depicted at 100. Projectiles travel in a generally horizontal zone of travel 112, 112' and 112". The chamber is comprised of a back plate 136; two side plates 138 and 139; a top plate 140; a bottom collection area 142; and, Proximate to the shooter at the front of the chamber, an air restricting curtain 144. The back plate 136 is generally perpendicular to the generally horizontal zone of projectile travel 112 to abruptly obstruct the forward movement of projectiles and smash them into relatively harmless fragments. It will be appreciated that appropriate wear and impact resistant materials must be chosen for this back plate, preferably hardened steel of sufficient thickness to repeatedly stop the projectiles used. The side plates 138 and 139, top plate 140, and bottom collection area 142 stop substantially all of the secondary impacts, and the fragments move either into the chamber air as airborne particulate, or to the collection area by gravity 142.

It will be appreciated by one of ordinary skill in the art that the various plates can be attached to each other by any ordinary means such as bolting, welding or the like, or by novel means such as that described in my copending U.S. patent Ser. No. 08/375,618, which is adopted hereto and incorporated herein by this reference.

As projectiles travel along the generally horizontal zone of projectile travel 112, they pass through the air resistant curtain at a point 148, 148' or 148"', and later impact with the back plate. The curtain 144 is made of a material which restricts the movement of air flow into the chamber to maintain a negative air pressure in the chamber, but which allows the movement of projectiles through it. It is also necessarily resistant to the passage of fragments in the general direction of the shooter. That is to say that it must allow the movement of un-fragmented bullets in one direction, and restrict the movement of any resultant fragments out of the chamber in substantially the opposite direction. Any fragments moving in the direction of the shooter will be relatively small as the impact plate is substantially perpendicular to the path of the bullet, and thus, upon impact all fragments are of minimal mass and velocity as described in my copending application Ser. No. 08/315,552 adopted herein by reference. It will be appreciated that skill must be exercised in selecting the containment chamber configuration to minimize the size of fragments impacting the back of the curtain, and to choose the curtain material so as to contain those fragments. In the preferred embodiment, a fiber reinforced rubber material of a thickness of about ¼ inch is used. The curtain may be a solid sheet or strips of material hung from the top plate 140. In the preferred embodiment it is a solid sheet with an aperture of approximately 16" in diameter cut in the center of the shooting zone, the purpose of which will be explained shortly hereafter.

A deflector 149 is placed at the bottom of the curtain 144 to direct projectiles on an errant low path up towards the center of the back plate 136. This prevents the impact of such projectiles into the collection area 142, and consequential impacts of these later projectiles with the collected projectiles and fragments for reasons described above. The deflector 149 also prevents the escape of fragments from the bottom of the curtain 144 in the direction of the shooter.

The bottom collection area 142 is constructed of steel for easy recovery of bullets, fragments and contaminants, and which consists of a well sufficient for the collective containment of a reasonable amount of such.

An aperture 150 is disposed centrally in the top plate 140, a region of likely relatively high concentration of airborne particulate matter. A duct 152 is attached to the aperture of the top plate. The aperture and duct are constructed as described in the embodiment described in FIGS. 1 and 2 above, and serve the purpose hereinafter described.

Air is drawn from the chamber through the aperture 150, thus exerting an internal negative air pressure on the chamber 100. A sufficient volume of air is drawn through the aperture 150 to 1) draw air through the openings created by projectiles 148, 148' and 148" and any interstices between the various components of the chamber, and, 2) to create the negative air pressure above described. It will be appreciated that the rigidity of the air restrictive curtain 144, the number and total area of openings created by projectiles, and the number and extent of the interstices will dictate the required volume of air drawn. For this purpose, the curtain 144 is chosen from a material, described above, that substantially closes after a bullet passes through it, which is also inexpensive to replace and of a low volume for disposal purposes. It is desirable in the preferred embodiment to cut a hole (previously described) in the curtain to allow a known volume of air into the chamber from initial installation through extensive use. This hole is disposed in the zone of greatest concentration of projectile travel. Thus, in combination with a closing material, significantly eliminating flow variables due to wear.

The chamber described above may also be restricted by means other than a curtain. For example, the sides, top and bottom may be elongate so as to decrease airflow therethrough and reduce emissions in the direction proximate to the shooter. The opening may also be restricted and obstructed by deflectors or other mechanical apparatus.

Figure 5:
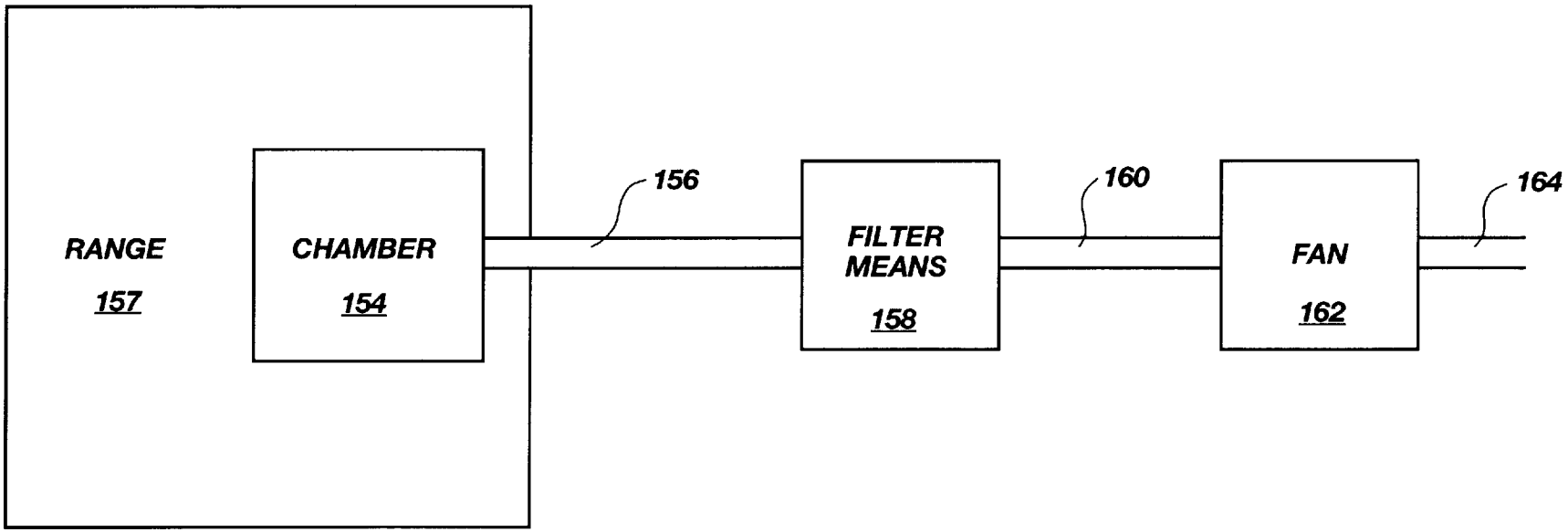

Turning now to the schematic drawing of FIG. 5. A bullet stopping and trapping chamber 154, as may be as disclosed and described above comprising of a substantially enclosed area for the arrest and containment of bullets, fragments and particulates is disposed in a range 157 in which shooters fire at targets and the like on predicable trajectories. The chamber is in pneumatic connection with filter means 158 by a duct 156 of sufficient cross sectional area to move the required volumes of air from the chamber. The filter means are in pneumatic connection with a fan 162 by a duct 160 of sufficient cross sectional area to move the required volumes of air from the filter means 158 to the fan 162. The fan is in pneumatic connection with an exhaust duct 164 of sufficient cross sectional area to move the air from the fan 162 to an ambient exhaust area (not depicted).

It will be appreciated that more than one chamber 154 may be connected in series with the filter means 158 by a number of ducts 156, or by a manifold system connecting the chambers to the filter.

The filter means 158 may consist of mesh filters, high efficiency particulate or absolute filter ("HEPA") units, electrostatic filters, or any combination of the same. In the preferred embodiment a self cleaning mesh canister filter is followed by a single redundant HEPA filter. The fan 162 or other means to move the air is selected from a number of known embodiments. The volume and force required for the described functions are factors of design consideration. In the preferred embodiment the fan is a turbine blower driven by an electric motor. The filter 158 and the fan 162 may be disposed within a range enclosure, if any, (to protect them from environmental forces), in a separate enclosure, or outside.

The air is exhausted preferably to an area outside and away from the range 157. This provides the benefit of creating an airflow away from the shooter if the range is substantially enclosed. An opening to ambient air may be disposed up-range behind the shooter to enhance this. It is also a comfort and safety expedient, in the event of failure of the filter means 158 to remove the undesirable particulate matter to an area distant from the shooters.

The present invention represents a significant advance over conventional bullet stop and containment apparatus. It is noted that many of the advantages of the present invention accrue due to novel management of airborne particulate matter and continuous containment of bullets and fragments and fabrication primarily from flat plates which can be readily purchased, stocked, inventoried, shipped, and fabricated and which are not cross contaminated. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A bullet stop and containment chamber for stopping the forward momentum of projectiles in a generally horizontal zone of projectile travel and for containing and removing contaminants, said bullet stop and containment chamber comprising:

a substantialy enclosed chamber comprising an opening for receiving projectiles on a generally predicted path, and stopping means for arresting the inertial movement of bullets and resulting fragments within the chamber, the chamber having an egress at its lowerst point from which bullets and fragments move under substantially gravitational forces;

a first duct in pneumatic connection with the chamber; and a fan in pneumatic connection with the first duct wherein the fan exerts an air pressure within the chamber which is less than that outside the chamber and sufficient to prevent the movement of airborne particular matter from within the chamber to ambient air.

2. A bullet stop and containment chamber as in claim 1 further comprising a second duct in pneumatic connection with the fan, which second duct exhausts air from the chamber to an area away from the chamber.

3. A bullet stop and containment chamber as in claim 1 further comprising filtration means in pneumatic connection with the fan for filtration of contaminants from the chamber.

4. A bullet stop and containment chamber as in claim 3 wherein the filtration means comprises at least one HEPA filter.

5. A bullet stop and containment chamber as in claim 3 wherein the filtration means comprises at least one electrostatic air filter.

6. A bullet stop and containment chamber as in claim 3 wherein the filtration means comprises at least one self cleaning mesh filter.

7. A bullet stop and containment chamber as in claim 1 wherein the chamber is disposed within a substantially enclosed shooting range, the shooting range being in pneumatic connection with the chamber and wherein air flows from the range proximal to a shooter, through the chamber and is exhausted outside the range.

8. A bullet stop and containment chamber as in claim 1 further comprising at least one channel, said at least one channel having at least one guide plate disposed at acute angles to the generally horizontal zone of projectile travel, a wide opening and a narrow opening, said narrow opening distal to a shooter and coextensive with the chamber opening and airflow through the channel from the wide opening to the narrow opening.

9. A bullet stop and containment chamber as in claim 8 wherein the at least one channel gradually decreases in cross sectional area from the wide opening to the narrow opening, an incidence of impact of projectiles in the channel which increases from the wide opening to the narrow opening, and wherein the rate of airflow through the channel increases from the wide opening to the narrow opening.

10. A bullet stop and containment chamber as in claim 1 further comprising a back plate disposed distally to a shooter said back plate substantially perpendicular to the generally horizontal zone of projectile travel, side plates and a top plate disposed orthogonally to the back plate, and a bottom collection area.

11. A bullet stop and containment chamber as in claim 10 further comprising a curtain disposed across an opening defined by the side plates, the top plate and the bottom collection area.

12. A bullet stop and containment chamber as in claim 11 wherein said curtain is comprised of fiber reinforced rubber.

13. A bullet stop and containment chamber as in claim 11 further comprising a deflector disposed between a shooter and the curtain at the base of said curtain such that bullets fired on a trajectory to intersect the bottom collection area are redirected to the back plate.

14. A bullet stop and containment chamber for stopping the forward momentum of projectiles on a generally horizontal zone of projectile travel and for containing and removing contaminants, said bullet stop and containment chamber comprising:

a channel to guide projectiles from a first opening to a second opening, said first opening having a greater area than said second opening;

a chamber defined at a chamber perimeter by at least two planar impact plates to arrest the inertial momentum of bullets and resulting fragments thereof and a planar terminal impact plate, said chamber further defined at the sides by first and second side plates;

said chamber further having an ingress complementary and adjacent to the second opening of the channel and an egress for the gravitational discharge of projectiles whose inertial momentum has been arrested within the chamber;

a fan in pneumatic connection with the chamber wherein said fan exerts an air pressure within the chamber which is less than that outside the chamber and wherein said fan removes a volume of air from the chamber; and, at least one duct in pneumatic connection with the chamber, wherein said at least one duct transports air away from the chamber.

15. A bullet stop and containment chamber as in claim 14 further comprising an aperture disposed in the terminal impact plate, said air pressure being exerted on the chamber through said aperture, and said volume of air being removed from the chamber through said aperture.

* * * * *